US008882553B2

(12) United States Patent
Hanrahan

(10) Patent No.: US 8,882,553 B2
(45) Date of Patent: Nov. 11, 2014

(54) FOREARM BOAT

(71) Applicant: Terrence Michael Hanrahan, Mission Viejo, CA (US)

(72) Inventor: Terrence Michael Hanrahan, Mission Viejo, CA (US)

( * ) Notice: Subject to any disclaimer, the term of this patent is extended or adjusted under 35 U.S.C. 154(b) by 211 days.

(21) Appl. No.: 13/707,494

(22) Filed: Dec. 6, 2012

(65) Prior Publication Data

US 2014/0162512 A1 Jun. 12, 2014

(51) Int. Cl.
*B63B 1/00* (2006.01)
*B63B 35/00* (2006.01)
*B63B 35/85* (2006.01)

(52) U.S. Cl.
CPC ..... *B63B 35/85* (2013.01)
USPC ..... 441/65

(58) Field of Classification Search
USPC ..... 441/65–67, 74, 75, 79; 114/312, 313, 114/315, 55.5, 55.58
See application file for complete search history.

(56) References Cited

U.S. PATENT DOCUMENTS

| | | | | |
|---|---|---|---|---|
| 193,455 | A * | 7/1877 | Lassonde | 137/625.21 |
| 1,175,571 | A | 3/1916 | Robertson | |
| 2,018,548 | A | 10/1935 | Currey | |
| 2,211,536 | A | 11/1939 | Clayton | |
| 2,559,977 | A | 3/1949 | Lundborg | |
| 2,762,063 | A | 9/1956 | Quinn | |
| 2,816,299 | A | 12/1957 | Holladay | |
| 3,042,945 | A | 7/1962 | Saeman | |
| 3,045,264 | A | 7/1962 | Smith | |
| 3,092,857 | A | 6/1963 | Churchman | |
| 3,117,325 | A * | 1/1964 | Shelton | 416/63 |
| 3,145,400 | A | 8/1964 | Yoakum | |
| 3,237,222 | A | 3/1966 | Frost | |
| 3,384,910 | A | 5/1968 | Heston | |
| 3,417,415 | A | 12/1968 | Kozak | |
| 3,514,798 | A | 6/1970 | Ellis | |
| 3,529,313 | A | 9/1970 | Girden | |
| 3,803,652 | A | 4/1974 | Uyehara | |
| 3,942,205 | A | 3/1976 | Lind | |
| 3,970,324 | A | 7/1976 | Howat | |
| 4,129,911 | A | 12/1978 | McDonald | |
| 4,209,867 | A | 7/1980 | Abrams | |
| D256,604 | S | 8/1980 | Arzoian | |
| 4,301,562 | A | 11/1981 | Durr | |
| D262,477 | S | 12/1981 | Lewis | |
| 4,302,860 | A | 12/1981 | Puch | |
| D263,860 | S | 4/1982 | Cole | |
| D264,370 | S | 5/1982 | McCarthy | |
| 4,331,340 | A | 5/1982 | Bolen | |
| D265,116 | S | 6/1982 | Churchill | |

(Continued)

*Primary Examiner* — Daniel V Venne
(74) *Attorney, Agent, or Firm* — Joshua C. Harrison, Esq.; Barcelo, Harrison & Walker, LLP.

(57) ABSTRACT

A forearm boat has a boat hull having a forearm channel that is recessed into the boat hull by a channel depth of at least 0.5 inches. The forearm channel is disposed along the boat hull's longitudinal axis, between the port side and the starboard side. The forearm channel has a channel length in the range 10 inches to 25 inches, and a channel width in the range 3 inches to 7 inches. A handle is attached to the boat hull and has a handle length in the range 3 inches to 7 inches, and is disposed closer to the bow than to the stern. The boat hull defines an overall hull length between the bow and the stern that is no greater than 2.2 times the channel length, and a beam that is no more than 2.2 times the channel width.

16 Claims, 4 Drawing Sheets

(56) References Cited

U.S. PATENT DOCUMENTS

| | | | | | |
|---|---|---|---|---|---|
| 4,362,518 | A | | 12/1982 | Boissiere | |
| 4,437,842 | A | | 3/1984 | Connor | |
| 4,439,165 | A | | 3/1984 | Rothstein | |
| 4,538,540 | A | | 9/1985 | Cashmere | |
| 4,571,195 | A | | 2/1986 | Brooks, Jr. | |
| 4,690,651 | A | * | 9/1987 | Samson et al. | 441/56 |
| 4,708,675 | A | | 11/1987 | Shoeffler | |
| 4,752,260 | A | | 6/1988 | Stewart | |
| 4,886,476 | A | | 12/1989 | Brocone | |
| 4,894,034 | A | | 1/1990 | Brown, III | |
| 4,929,207 | A | | 5/1990 | Piatt | |
| 4,990,113 | A | | 2/1991 | Morrison | |
| D317,194 | S | | 5/1991 | Brocone | |
| D318,894 | S | | 8/1991 | Harling | |
| D321,547 | S | | 11/1991 | Albrecht | |
| D329,633 | S | | 9/1992 | Rodgers | |
| 5,167,551 | A | | 12/1992 | Davis | |
| 5,275,860 | A | | 1/1994 | D'Luzansky | |
| 5,472,362 | A | | 12/1995 | Dandurand | |
| D367,089 | S | * | 2/1996 | Hughes et al. | D21/678 |
| 5,603,645 | A | | 2/1997 | Saccomanno | |
| D412,352 | S | | 7/1999 | Falconer | |
| D412,353 | S | | 7/1999 | Falconer | |
| 6,254,649 | B1 | | 7/2001 | Sherman et al. | |
| 6,428,376 | B1 | | 8/2002 | Reeder | |
| 6,431,932 | B1 | | 8/2002 | Pederson | |
| 6,544,089 | B2 | | 4/2003 | Zapatero Denegri | |
| 7,029,351 | B1 | | 4/2006 | Reid et al. | |
| D529,117 | S | * | 9/2006 | Chiang | D21/807 |
| 7,261,050 | B2 | | 8/2007 | Brauers | |
| D578,596 | S | * | 10/2008 | Hicks | D21/807 |
| D585,104 | S | * | 1/2009 | McCarthy | D21/807 |
| 7,955,150 | B2 | | 6/2011 | Friedrich | |
| 8,105,125 | B2 | * | 1/2012 | Sick | 441/56 |
| D683,414 | S | * | 5/2013 | Bell | D21/806 |
| 2008/0146100 | A1 | | 6/2008 | Friedrich | |
| 2011/0104969 | A1 | | 5/2011 | Leblanc | |

* cited by examiner

FOREARM BOAT

FIELD OF THE INVENTION

The present invention relates generally to devices for aiding aquatic sports such as surfing and swimming, and more particularly to devices that can enhance body surfing.

BACKGROUND

In the sports of surfing and wave riding, there are several ways for a person to ride a wave. For example, the rider may stand, kneel, sit, or ride prone within or on the surface of a wave. In wakeboarding, a rider is pulled across the surface of a wave created by a towing powered water craft.

Several sports include the use of a board as essential equipment, and so may be referred to as "board sports." Board sports include, for example, wakeboarding, snowboarding, surfing, paddelboarding, windsurfing, boogie boarding, and kitesurfing. Surfboards come in various sizes, the smallest being so-called "boogie boards" (upon which most riders rarely stand), and the largest being so-called "stand-up paddle" (SUP) boards (upon which a surfer is usually in a standing position even when not riding a wave). So-called "short boards" and "long boards" are surfboards (upon which a surfer typically alternates between prone and kneeling or standing positions) that are larger than boogie boards but smaller than SUP boards. Surfboards can be so-called "soft boards" made of foam, or "hard boards" typically made of foam encased in substantially rigid fiberglass, carbon/epoxy composite, and/or wood.

Windsurfing boards can range in size from being approximately the size of a short board, to being the size of a SUP board. Paddle boards, which include ocean rescue paddle boards, may be as large as, and often even longer than, SUP boards. Kitesurfing boards are generally smaller than short boards, but larger than boogie boards. Snowboards are generally narrower and smaller than short boards, while being longer than most skateboards. Some boards and other devices originally conceived for use in liquid water (e.g. boogie boards) have been used or adapted for use in snow, and such adaptations are contemplated herein.

However, many wave riders do not use a board at all. For example, body surfing is not considered to be a "board sport," because the body surfer does not stand, sit, kneel, or even lie prone upon a board. That is, the weight of the body surfer is not supported by the planing action of the board surface planing on the water surface. Rather, the body surfer planes across the surface of the water with his or her body, with his/her weight supported by the planing action of the major surfaces of the natural body (chest, abdomen, legs) on the water surface.

Many body surfers control their ride by positioning (e.g. twisting or angling) only natural body surfaces (chest, abdomen, legs) that are planing on the water surface or dragging through the water. However, some body surfers find that they can improve or better initiate or control their ride by attaching fins to their feet and/or using conventional flat planar paddles on their hands. For example, a body surfer may temporarily transfer some upper body weight to be partially supported by the planing action of hand paddles, to enhance speed or control while riding a wave.

The prior art is crowded with issued patents on specific aspects and improvements to hand paddles for body surfing. For example, several issued US patents, such as U.S. Pat. No. 4,437,842 to Connor, U.S. Pat. No. 5,167,551 to Davis, U.S. D263,860 to Cole, U.S. D318,894 to Harling, U.S. D321,547 to Albrecht, and U.S. D329,633 to Rogers, disclose and claim specific aspects, features and/or improvements to hand paddles that may be used for body surfing.

Still, the surface area and buoyancy of flat hand-sized paddles is inherently limited, and there remains a need in the art for improved devices to enhance body surfing. For example, there is an ongoing need in the art for devices that may provide more support and/or more control to a body surfer, than can hand paddles.

DETAILED DESCRIPTION OF EXEMPLARY EMBODIMENTS

Figure 1:
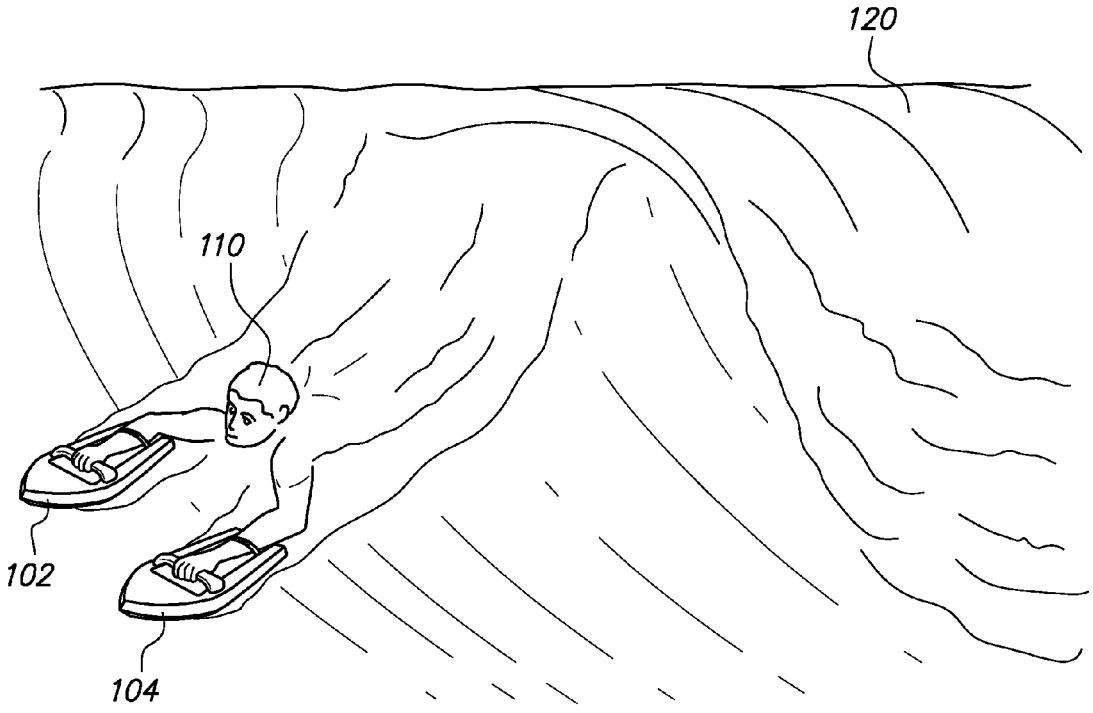
FIG. 1 depicts an embodiment of the present invention, in use by a body surfer.

FIG. 1 depicts forearm boats 102 and 104 according to an embodiment of the present invention, in use by a body surfer 110 who is riding a wave 120. Note that in the embodiment of FIG. 1, the forearm boats 102, 104 extend longitudinally from the hands of the body surfer 110 towards and substantially to (or even beyond) the elbows of the body surfer 110. In certain embodiments, such longitudinal extension may be critical, because it may enable the body surfer to transfer substantially more of his/her body weight on to the forearm boats 102, 104 for a longer period while riding.

Figure 2A:
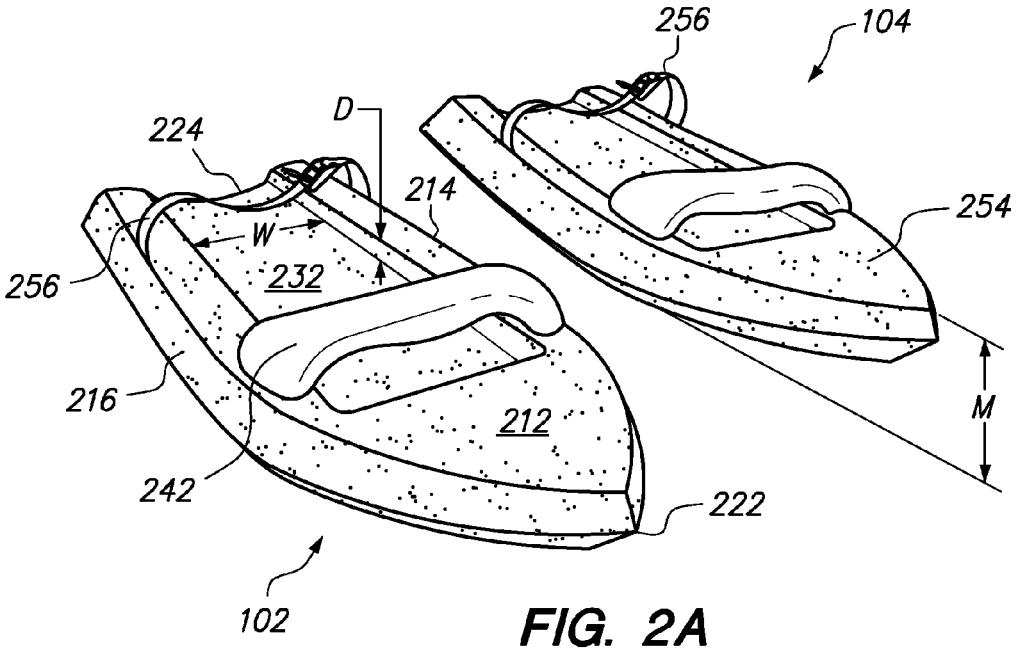
FIG. 2A is a perspective view of an embodiment of the present invention.
Figure 2B:
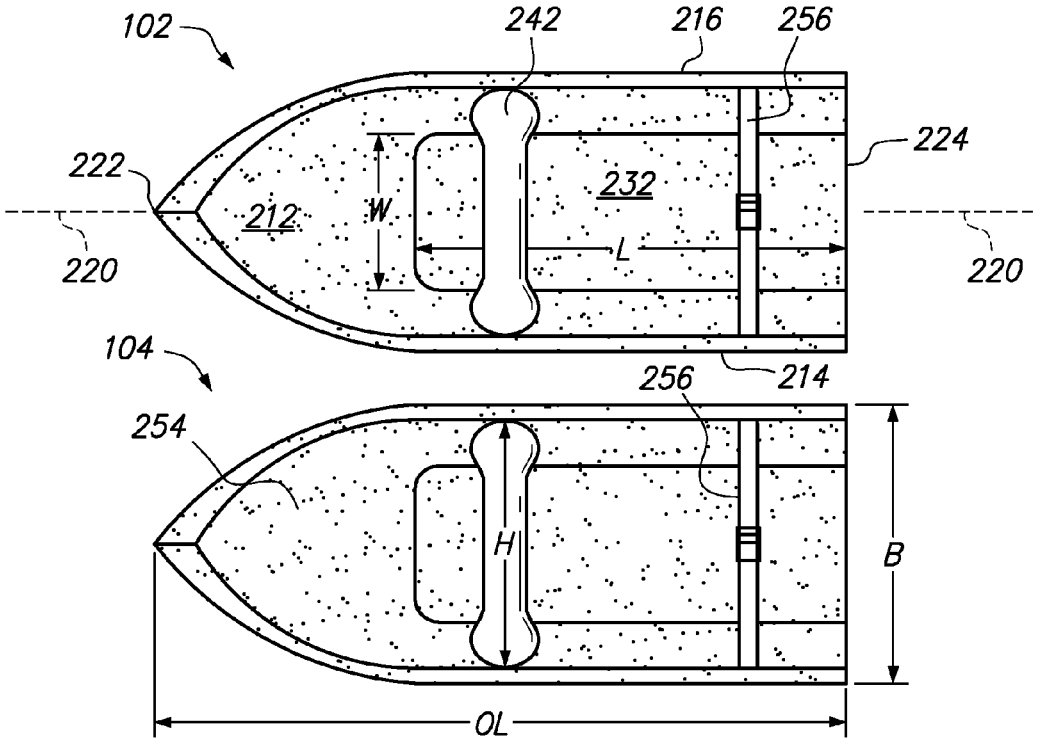
FIG. 2B is a top plan view of the embodiment of FIG. 2A.

FIG. 2A is a perspective view of an embodiment of the present invention. FIG. 2B is a top plan view of the embodiment of FIG. 2A. Now referring to FIGS. 2A & 2B, the forearm boat 102 includes a boat hull 212 having a port side 214 and a starboard side 216. The boat hull 102 defines a longitudinal axis 220 running from a bow 222 to a stern 224. In the embodiment of FIGS. 2A & 2B, the boat hull 212 includes a shallow V-hull shape having a pointed bow 222 and a blunt stern 224. However, in various embodiments, the boat hull 212 may include other shapes (e.g. other V-hull shapes, S-hull shapes, cathedral hull shapes, or tunnel hull shapes, etc). The boat hull 212 optionally may also include one or more removable or fixed protruding skegs, to improve directional control.

In the embodiment of FIGS. 2A & 2B, a forearm channel 232 is recessed into the boat hull by a channel depth D that is preferably at least 0.5 inches. FIG. 2B shows that the forearm channel 232 is disposed along the longitudinal axis 220 between the port side 214 and the starboard side 216. The forearm channel 232 is preferably closed at the bow 222 and open at the stern 224. The forearm channel preferably defines a channel width W in the range 3 inches to 7 inches. The forearm channel 232 preferably defines a channel length L in the range 10 inches to 25 inches. In certain embodiments, such dimensional ranges may be critical, because they may enable the body surfer to transfer substantially more of his/her body weight on to the forearm boat 102 for a longer period while riding.

In the embodiment of FIGS. 2A & 2B, the forearm boats 102 and 104 are optionally identical, so that numerical labels that are applicable to the forearm boat 104 are also applicable to the forearm boat 102. For example, in the embodiment of FIGS. 2A & 2B, the forearm boat 102 is symmetric about the longitudinal axis 220, with the longitudinal axis 220 bisecting the boat hull 212. In other embodiments, however, the forearm boat for the user's left hand may be asymmetric or different from the forearm boat for the user's right hand. Alternatively, in other embodiments, only a single forearm boat may be sold or used by a user (for example, a body surfer who prefers to ride a wave using only a single forearm boat).

In the embodiment of FIGS. 2A & 2B, the boat hull 212 defines an overall hull length OL between the bow 222 and the stern 224 that is preferably no greater than 2.2 times the channel length L. The boat hull 212 also defines a beam B that is preferably no more than 2.2 times the channel width W. Note: In this context, the beam B is the maximum hull width between the port side 214 and the starboard side 216. The boat hull 212 also defines a molded depth M in the range 1.5 to 7 times the channel depth D. Note: In this context, the molded depth M is the maximum height of the hull 212 measured from the lowest point on the bottom to the upper deck 254. In certain embodiments, one or more of the foregoing dimensional ranges may be critical to the strength, function, and/or fit of the forearm boats 102, 104.

In the embodiment of FIGS. 2A & 2B, a handle 242 spans the forearm channel 232 and is oriented transverse to the longitudinal axis 220. In this context, "transverse" means approximately perpendicular (i.e. within ±20 degrees of perfect perpendicularity). The handle 242 is attached to the boat hull 212, and is disposed closer to the bow 222 than to the stern 224. In the embodiment of FIGS. 2A & 2B, the handle 242 is shown to be disposed above the upper deck 254 but could also be disposed below the upper deck 254 (i.e. within the forearm channel 232). The handle 242 preferably has a handle length H in the range 3 inches to 7 inches. In the embodiment of FIGS. 2A & 2B, the handle 242 is substantially rigid (i.e. rigid as perceived by an ordinary user, but not perfectly theoretically rigid since all practical materials have finite stiffness). In certain embodiments, such geometry and rigidity may be critical to enable the rider to adequately control the forearm boat 102 during use.

For example, in the embodiment of FIGS. 2A & 2B, the boat hull 212 may comprise a rigid foam material (e.g. expanded polypropylene, expanded polystyrene, or the like). In certain embodiments, the boat hull 212 and the handle 242 may be a single integral monolithic component rather than being an assembly of subcomponents. However, in certain other embodiments, the boat hull 212 and the handle 242 may be an assembly of distinct subcomponents to enhance manufacturability and/or to make the handle 242 detachable and/or removable/replaceable.

Optionally, the boat hull 212 may include an impermeable skin (e.g. high density polyethylene, ethylene propylene, ethylene vinyl acetate copolymers, polyolefin films, or the like) bonded or otherwise attached to the foam material. In certain embodiments, such an impermeable skin may resist weight gain by water absorption, may enhance speed through a smoother surface, and/or may increase the durability or lifetime of the forearm boat 102.

In the embodiment of FIGS. 2A & 2B, each of the forearm boats 102, 104 optionally comprises a flexible strap 256 attached to the boat hull 212 and spanning the forearm channel 232. The flexible strap 256 is preferably closer to the stern 224 than to the bow 222, and may, in certain embodiments, enhance the user control. In certain embodiments, the forearm boat 102 may optionally include a conventional leash having a proximal end attached to the boat hull 212 or to the handle 242, and having a distal end that includes a conventional wrist attachment. The inclusion and use of such a conventional leash may help prevent loss of the forearm boat 102 during ocean use.

Figure 3A:
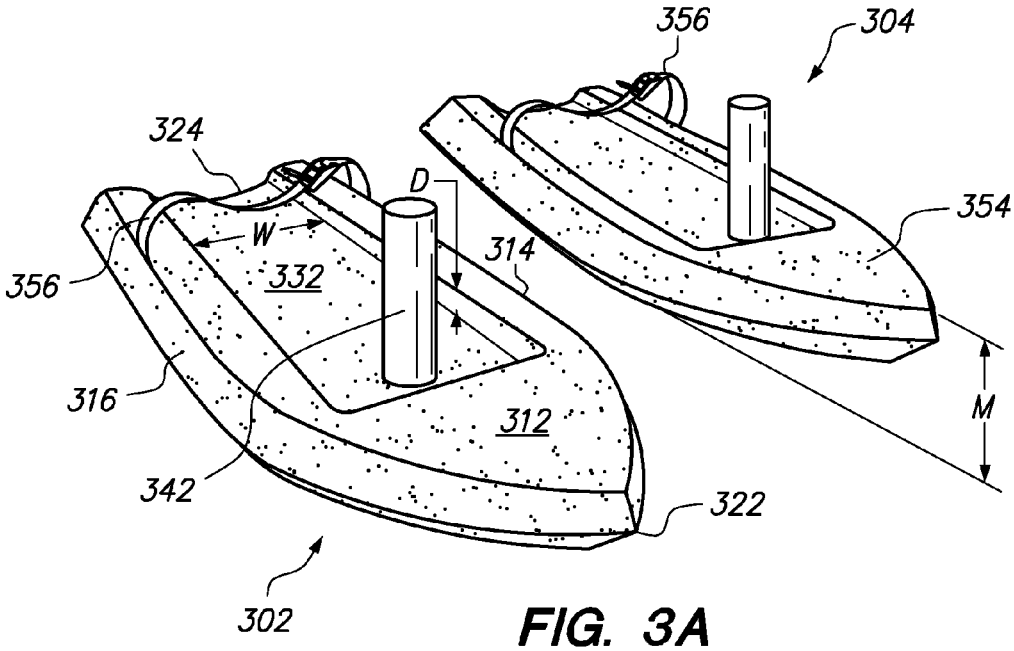
FIG. 3A is a perspective view of an embodiment of the present invention.
Figure 3B:
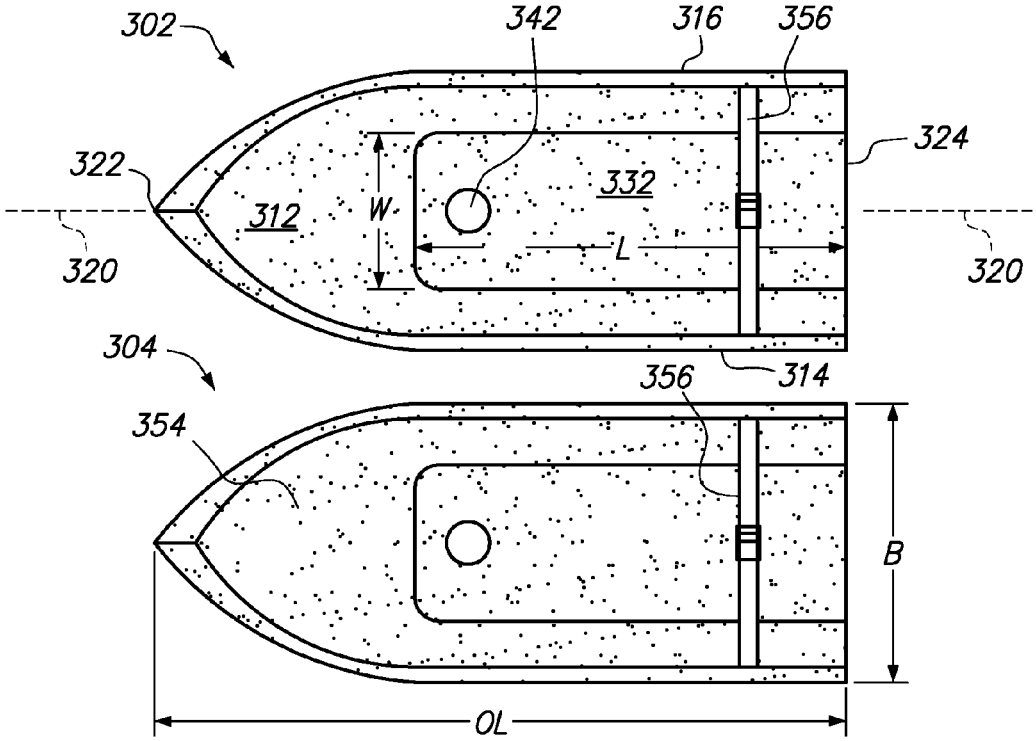
FIG. 3B is a top plan view of the embodiment of FIG. 3A.

FIG. 3A is a perspective view of an embodiment of the present invention. FIG. 3B is a top plan view of the embodiment of FIG. 3A. Now referring to FIGS. 3A & 3B, the forearm boat 302 includes a boat hull 312 having a port side 314 and a starboard side 316. The boat hull 302 defines a longitudinal axis 320 running from a bow 322 to a stern 324. In the embodiment of FIGS. 3A & 3B, the boat hull 312 includes a shallow V-hull shape having a pointed bow 322 and a blunt stern 324. However, in various embodiments, the boat hull 312 may include other shapes (e.g. other V-hull shapes, S-hull shapes, cathedral hull shapes, or tunnel hull shapes, etc).

In the embodiment of FIGS. 3A & 3B, a forearm channel 332 is recessed into the boat hull by a channel depth D that is preferably at least 0.5 inches. FIG. 3B shows that the forearm channel 332 is disposed along the longitudinal axis 320 between the port side 314 and the starboard side 316. The forearm channel 332 is preferably closed at the bow 322 and open at the stern 324. The forearm channel preferably defines a channel width W in the range 3 inches to 7 inches. The forearm channel 332 preferably defines a channel length L in the range 10 inches to 25 inches. In certain embodiments, such dimensional ranges may be critical, because they may enable the body surfer to transfer substantially more of his/her body weight on to the forearm boat 302 for a longer period while riding.

In the embodiment of FIGS. 3A & 3B, the forearm boats 302 and 304 are optionally identical, so that numerical labels that are applicable to the forearm boat 304 are also applicable to the forearm boat 302. For example, in the embodiment of FIGS. 3A & 3B, the forearm boat 302 is symmetric about the longitudinal axis 320, with the longitudinal axis 320 bisecting the boat hull 312. In other embodiments, however, the forearm boat for the user's left hand may be asymmetric or different from the forearm boat for the user's right hand. Alternatively, in other embodiments, only a single forearm boat may be sold or used by a user (for example, a body surfer who prefers to ride a wave using only a single forearm boat).

In the embodiment of FIGS. 3A & 3B, the boat hull 312 defines an overall hull length OL between the bow 322 and the stern 324 that is preferably no greater than 2.2 times the channel length L. The boat hull 312 also defines a beam B that is preferably no more than 2.2 times the channel width. Note: In this context, the beam B is the maximum hull width between the port side 314 and the starboard side 316. The boat hull 312 also defines a molded depth M in the range 1.5 to 7 times the channel depth D. Note: In this context, the molded depth M is the maximum height of the hull 312 measured from the lowest point on the bottom to the upper deck 354. In certain embodiments, one or more of the foregoing dimensional ranges may be critical to the strength, function, and/or fit of the forearm boats 302, 304.

In the embodiment of FIGS. 3A & 3B, a handle 342 is oriented as a post protruding vertically from within the forearm channel 332. In this context, "vertical" means approximately normal (i.e. within ±20 degrees of perfect normality) to the lower surface of the forearm channel 332, and does not refer to any specific orientation with respect to gravity at any particular time of use. The handle 342 is attached to the boat hull 312, and is disposed closer to the bow 322 than to the stern 324. In the embodiment of FIGS. 3A & 3B, the handle 342 is substantially rigid (i.e. rigid as perceived by an ordinary user, but not perfectly theoretically rigid since all practical materials have finite stiffness). In certain embodiments, such geometry and rigidity may be critical to enable the rider to adequately control the forearm boat 302 during use.

For example, in the embodiment of FIGS. 3A & 3B, the boat hull 312 may comprise a rigid foam material (e.g. expanded polypropylene, expanded polystyrene, or the like). The handle 342 optionally may be made of a conventional stiff plastic material that is conventionally attached to the boat hull 312. Optionally, the boat hull 312 may include an impermeable skin (e.g. high density polyethylene, ethylene propylene, ethylene vinyl acetate copolymers, polyolefin films, or the like) on the foam material. In certain embodiments, such an impermeable skin may resist weight gain by water absorption, may enhance speed through a smoother surface, and/or may increase the durability or lifetime of the forearm boat 302.

In the embodiment of FIGS. 3A & 3B, each of the forearm boats 302, 304 optionally comprises a flexible strap 356 attached to the boat hull 312 and spanning the forearm channel 332. The flexible strap 356 is preferably closer to the stern 324 than to the bow 322, and may, in certain embodiments, enhance the user control. In certain embodiments, the forearm boat 302 may optionally include a conventional leash having a proximal end attached to the boat hull 312, and having a distal end that includes a conventional wrist attachment. The inclusion and use of such a conventional leash may help prevent loss of the forearm boat 302 during ocean use.

Figure 4:
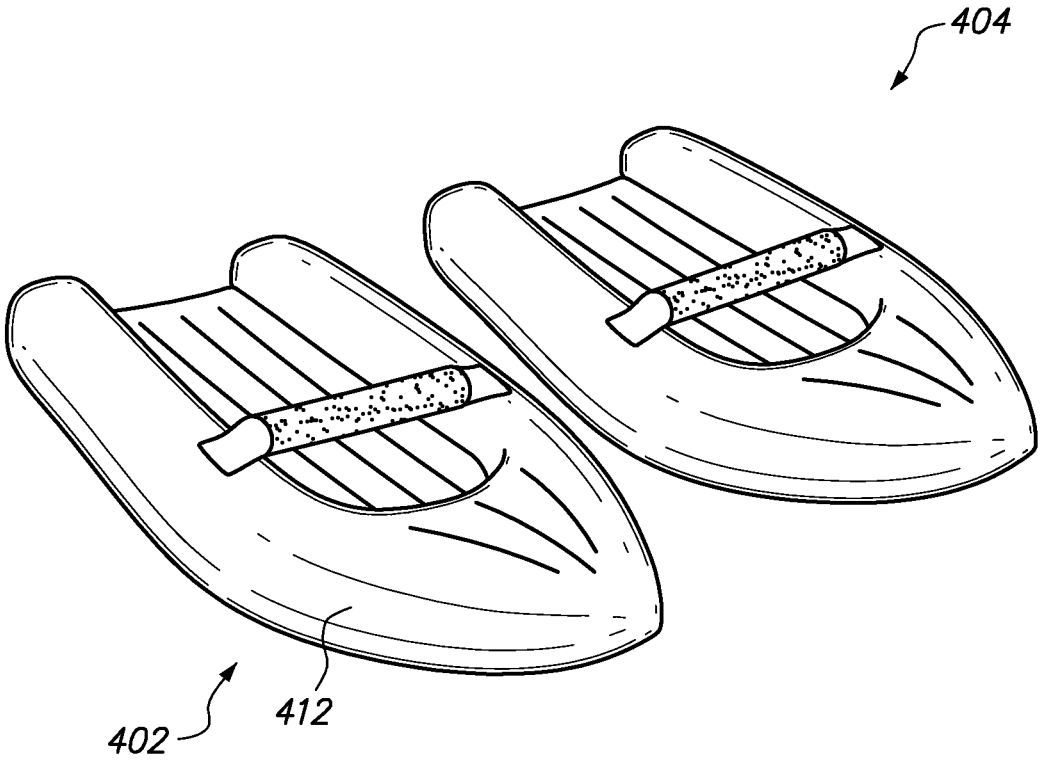
FIG. 4 is a perspective view of an embodiment of the present invention.

FIG. 4 depicts forearm boats 402, 404 in accordance with another embodiment of the present invention. The forearm boats 402, 404 are similar to the forearm boats 102, 104 of the embodiment of FIG. 2A, with the description of the forearm boats 102, 104 being also applicable to the forearm boats 402, 404, except for the description of the boat hull material. Rather, with regards to the boat hull material, in the embodiment of FIG. 4 the boat hull 412 is an inflatable boat hull comprising a sheet material (e.g. polyvinyl chloride (PVC) films, thermal polyurethane (TPU) films, polyester fabrics coated with PVC, nylon fabrics coated with PVC, polyester fabrics coated with TPU, nylon fabrics coated with TPU, or the like) that is inflated with a gas such as air.

In the foregoing specification, the invention is described with reference to specific exemplary embodiments, but those skilled in the art will recognize that the invention is not limited to those. It is contemplated that various features and aspects of the invention may be used individually or jointly and possibly in a different environment or application. The specification and drawings are, accordingly, to be regarded as illustrative and exemplary rather than restrictive. For example, the word "preferably," and the phrase "preferably but not necessarily," are used synonymously herein to consistently include the meaning of "not necessarily" or optionally. "Comprising," "including," and "having," are intended to be open-ended terms.

What is claimed is:

1. A forearm boat comprising:

a boat hull having a port side and a starboard side, the boat hull defining a longitudinal axis running from a bow to a stern;

a forearm channel recessed into the boat hull by a channel depth of at least 0.5 inches, the forearm channel being disposed along the longitudinal axis between the port side and the starboard side, the forearm channel defining a channel length in the range 10 inches to 25 inches, the forearm channel defining a channel width in the range 3 inches to 7 inches;

a handle attached to the boat hull and having a handle length in the range 3 inches to 7 inches, the handle being disposed closer to the bow than to the stern;

wherein the boat hull defines an overall hull length between the bow and the stern that is no greater than 2.2 times the channel length, and a beam that is no more than 2.2 times the channel width.

2. The forearm boat of claim 1 wherein the handle spans the forearm channel, the handle being oriented transverse to the longitudinal axis.

3. The forearm boat of claim 1 wherein the handle is a substantially rigid handle.

4. The forearm boat of claim 3 wherein the handle is oriented as a post protruding from within the forearm channel.

5. The forearm boat of claim 1 further comprising a flexible strap spanning the forearm channel, the flexible strap being attached to the boat hull, the flexible strap being disposed closer to the stern than to the bow.

6. The forearm boat of claim 1 wherein the boat hull has a pointed bow and a blunt stern.

7. The forearm boat of claim 1 wherein the boat hull includes a shape selected from the group consisting of V-hull shapes, S-hull shapes, cathedral hull shapes, and tunnel hull shapes.

8. The forearm boat of claim 1 wherein the boat hull defines a molded depth in the range 1.5 to 7 times the channel depth.

9. The forearm boat of claim 1 wherein the forearm boat is symmetric about the longitudinal axis, with the longitudinal axis bisecting the boat hull.

10. The forearm boat of claim 1 wherein the boat hull and the handle are a single integral monolithic component rather than being an assembly of subcomponents.

11. The forearm boat of claim 1 wherein the boat hull comprises a foam material selected from the group consisting of expanded polypropylene and expanded polystyrene.

12. The forearm boat of claim 11 wherein the boat hull includes an impermeable skin on the foam material, the impermeable skin comprising a skin material selected from the group consisting of high density polyethylene, ethylene propylene, ethylene vinyl acetate copolymers, and polyolefin films.

13. The forearm boat of claim 1 wherein the boat hull is an inflatable boat hull comprising a sheet material selected from group consisting of polyvinyl chloride (PVC) films, thermal polyurethane (TPU) films, polyester fabrics coated with PVC, nylon fabrics coated with PVC, polyester fabrics coated with TPU, and nylon fabrics coated with TPU.

14. The forearm boat of claim 1 further comprising a leash having a proximal end attached to the boat hull, and having a distal end that includes a wrist attachment.

15. The forearm boat of claim 1 further comprising a leash having a proximal end attached to the handle, and having a distal end that includes a wrist attachment.

16. The forearm boat of claim 1 wherein the forearm channel is closed at the bow and open at the stern.

* * * * *